US005753289A

United States Patent [19]

Ness

[11] Patent Number: 5,753,289

[45] Date of Patent: May 19, 1998

[54] PORTABLE FOOD CONTAINER AND METHOD FOR STORING AND DISPENSING DRY AND LIQUID FOOD

[76] Inventor: Richard B. Ness, 7710 128th St. W., Apple Valley, Minn. 55124

[21] Appl. No.: 735,917

[22] Filed: Oct. 24, 1996

Related U.S. Application Data

[62] Division of Ser. No. 401,813, Mar. 10, 1995, Pat. No. 5,588,561.

[51] Int. Cl.[6] ..... B65B 55/00

[52] U.S. Cl. ..... 426/394; 426/389; 426/398; 426/115; 426/12 D; 426/13 D; 426/506; 222/129; 222/143; 222/212; 222/215; 220/525; 220/555; 220/666; 220/711

[58] Field of Search ..... 426/389, 394, 426/398, 115, 120, 130, 506; 222/129, 143, 212, 215; 220/525, 526, 555, 666, 711; 206/217, 541

[56] References Cited

U.S. PATENT DOCUMENTS

| | | | |
|---|---|---|---|
| D. 258,796 | 4/1981 | Pauldes . | |
| 2,661,781 | 12/1953 | Huenergardt | 222/129 |
| 3,052,368 | 9/1962 | Atkins et al. . | |
| 3,194,426 | 7/1965 | Brown, Jr. | 222/143 X |
| 3,288,344 | 11/1966 | Woolen et al. | 206/217 X |
| 3,567,105 | 3/1971 | McFarlin | 206/216 |
| 3,603,485 | 9/1971 | Vivier et al. | 222/129 |
| 4,194,619 | 3/1980 | Schley | 206/217 |
| 4,277,000 | 7/1981 | Jaarsma . | |
| 4,703,849 | 11/1987 | Vezirian et al. . | |
| 4,948,715 | 8/1990 | Green | 222/212 X |
| 4,955,503 | 9/1990 | Propes . | |
| 5,143,261 | 9/1992 | Dorbish | 222/129 |
| 5,154,917 | 10/1992 | Ibrahim et al. | 222/129 X |
| 5,158,191 | 10/1992 | Douglas et al. | 222/143 X |
| 5,180,079 | 1/1993 | Jeng . | |
| 5,209,348 | 5/1993 | Schafer, III . | |
| 5,241,835 | 9/1993 | Ascone . | |
| 5,289,950 | 3/1994 | Gentile . | |
| 5,316,159 | 5/1994 | Douglas et al. | 222/143 X |
| 5,318,787 | 6/1994 | Brauner et al. | 206/216 X |
| 5,392,947 | 2/1995 | Gentile | 222/129 X |
| 5,482,170 | 1/1996 | Semersky et al. | 220/555 X |
| 5,588,561 | 12/1996 | Ness | 222/129 |

FOREIGN PATENT DOCUMENTS

| | | |
|---|---|---|
| 2670750 | 12/1990 | France . |

*Primary Examiner*—Donald E. Adams
*Assistant Examiner*—Jeffrey Stucker
*Attorney, Agent, or Firm*—Merchant, Gould, Smith, Edell, Welter & Schmidt

[57] ABSTRACT

A portable food container for use in holding dry and liquid foods for consumption. The container allows an individual to consume a combination of dry cereal and cold milk in a remote location away from the kitchen without the use of a bowl and a spoon. The portable food container is inverted to allow dry cereal to flow therefrom, and squeezed to allow milk to flow therefrom.

5 Claims, 3 Drawing Sheets

PORTABLE FOOD CONTAINER AND METHOD FOR STORING AND DISPENSING DRY AND LIQUID FOOD

This is a Divisional of application Ser. No. 08/401,813, filed Mar. 10, 1995, now U.S. Pat. No. 5,588,561 which application(s) are incorporated herein by reference.

FIELD OF THE INVENTION

The present invention relates to a portable food container for use by campers, commuters, hikers and the like, and to a method for storing and consuming dry and liquid food, and more particularly to a spill free portable food container which keeps dry and liquid food separate and provides for their combination prior to consumption.

BACKGROUND OF THE INVENTION

Dry cereal and milk are often combined to provide a popular breakfast meal, which is generally eaten from a bowl and consumed using a spoon. While such a meal is often convenient because it can be quickly prepared, consumed, and cleaned-up in a kitchen, it loses its convenience when commuting in a motor vehicle or while camping, hiking, etc. Accordingly, there exists a need for a container which can be used to provide a convenient meal of cereal and milk without using a conventional bowl and spoon. In addition, it would be desirable for such a container to be able to hold dry cereal and milk separate for several days without the cereal getting stale or the milk going bad.

U.S. Pat. Nos. 5,209,348 to Schafer, III and 5,241,835 to Ascone describe containers for holding cereal and milk in separate compartments. These containers provide for the cereal and milk to be combined in one compartment prior to consumption. While these containers help prevent cereal from becoming soggy while it is stored for consumption at a later date, they are intended to be used as a bowl. During certain activities, such as commuting, eating out of a bowl can become very messy. Furthermore, since using a bowl generally requires the use of a spoon, two hands are needed; one to hold the container and the other to hold the spoon. Accordingly, it would be desireable to provide a spill free container which can be used by commuters having only one free hand available while driving an automobile. In addition, it would be desireable to provide a container which provides a cereal and milk meal without the need for utensils thereby allowing greater flexibility when using the container and eliminating the need for subsequent cleaning and storage of utensils. Such a container would be convenient to use by commuters driving a car or riding a bus/subway/train, school-age children, and sports persons such as bikers, hikers, campers, fishers, hunters, etc.

SUMMARY OF THE INVENTION

A portable food container for storing dry food and liquid food and for consuming a meal prepared from combined dry food and liquid food is provided by the present invention. The portable food container has a divided compartment cup and a container lid which fits thereon to form a seal sufficient to prevent leakage of food. The divided compartment cup has a rigid compartment for holding dry food and a flexible compartment for holding liquid food. The container lid has a first opening for delivering dry food from the rigid compartment and a second opening for delivering liquid food from the flexible compartment. The wall of the divided cup surrounding the first compartment can be rigid to prevent the dry food from being crushed when squeezed by a human hand. The wall of the divided cup surrounding the second compartment can be insulated to provide a relatively stable temperature environment for the liquid food.

The portable food container is intended to be used to provide a convenient meal when away from the kitchen. The container can be operated using only one hand. By providing a device which separately contains dry and liquid food, and allows for their combination for consumption, it is possible to provide a convenient meal without the needs for bowls and/or utensils. The portable food container can allow an individual to consume a traditional meal of dry cereal and cold milk without the use of a bowl and a spoon. Preferably, the portable food container can be used to provide a spill free consumption of a cereal and milk meal, is convenient and easy to use and clean, is portable and lightweight, and is relatively safe to use while driving a car.

A method for storing dry and liquid food items in a portable food container prior to consumption is provided by the present invention. The method includes the steps of providing a divided compartment cup having a rigid compartment for holding dry food and a flexible compartment is for holding liquid food; adding dry food to the rigid compartment and liquid food to the flexible compartment; and covering the compartments of the divided compartment cup with a container lid. The container lid should have a first opening for delivering dry food from the rigid compartment and a second opening for delivering liquid food from the flexible compartment.

A method for consuming dry and liquid food items stored in a portable food container is provided by the present invention. The method includes the steps of providing a portable food container in an upright position, the portable food container including a divided compartment cup having a rigid compartment holding dry food and a flexible compartment holding liquid food, and a container lid covering the compartments of the divided compartment cup, the container lid having a first opening for delivering dry food from the rigid compartment and a second opening for delivering liquid food from the flexible compartment; rotating the portable food container to a dry food and liquid food dispensing position; and squeezing the flexible compartment to delivery liquid food therefrom. The method allows a controlled metering of a desired amount of dry food and liquid food into a person's mouth.

DETAILED DESCRIPTION OF THE INVENTION

Figure 2:
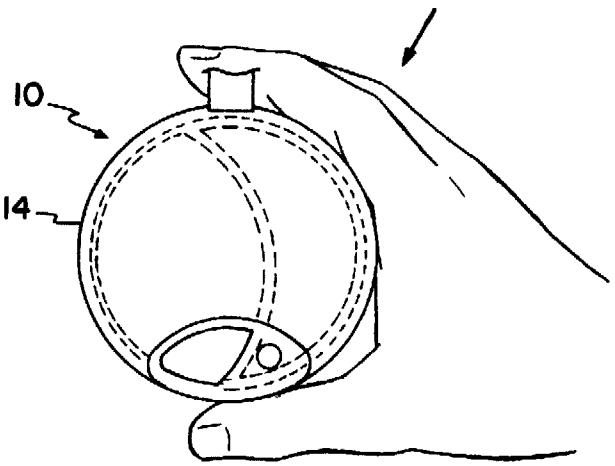
FIG. 2 is a top end view of the portable food container of FIG. 1 shown in operation.

The preferred embodiment of the invention will be described in detail with reference to the drawings, wherein like reference numerals represent like parts and assemblies throughout the several views. Reference to the preferred embodiment does not limit the scope of the invention, which is limited only by the scope of the claims attached hereto.

Figure 1:
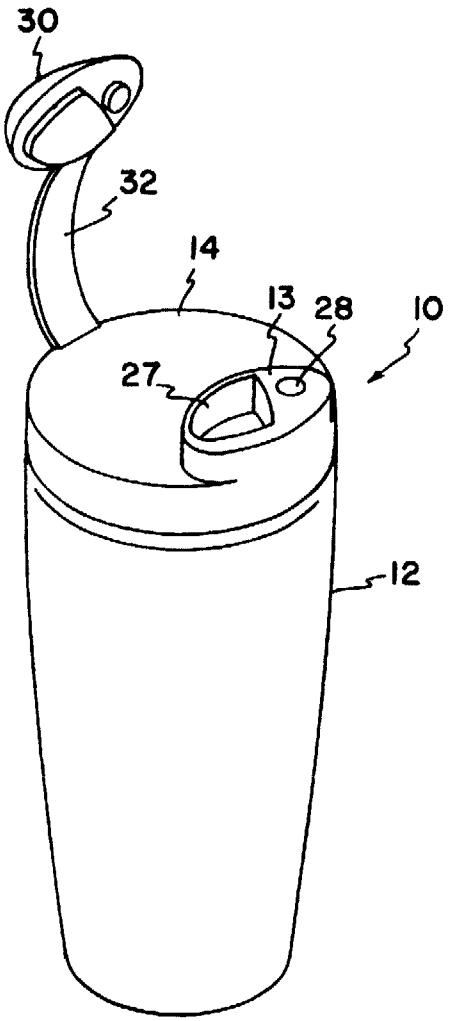
FIG. 1 is a perspective view of a portable food container in an open arrangement according to the principles of the present invention.
Figure 3:
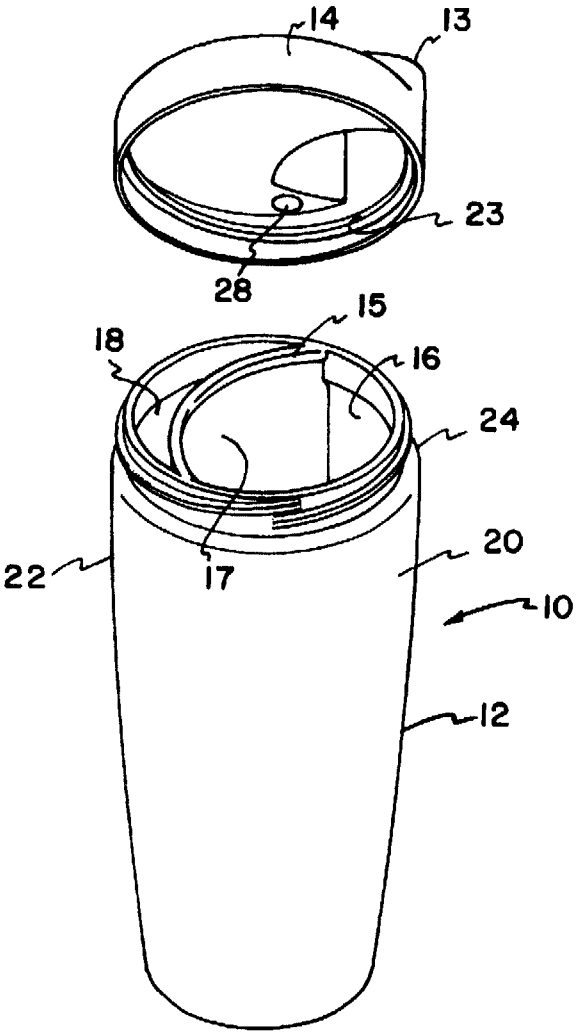
FIG. 3 is a perspective assembly view of the portable food container of FIG. 1.

Referring to FIGS. 1–3, a portable food container in accordance with this invention is illustrated generally at 10, where it is shown in the upright position which means that liquid and dry foods stored therein will remain separate and will not flow therefrom due to gravitational forces. In FIG. 2, the portable food container 10 is shown in the dispensing position which means that dry food will flow therefrom under gravity, and liquid food will flow therefrom upon application of pressure along the direction of the arrow. Generally, the liquid and dry food flow into a person's mouth for consumption. Liquid and dry food flowing from the portable food container 10 can initially gradually mix with each other and become completely mixed upon consumption. Advantageously, the portable food container 10 can be operated, as shown, using a single hand by application of pressure along the direction indicated by the arrow.

Portable food container 10 is shaped much like a large drinking glass. The divided compartment cup 12 is constructed and arranged for holding and keeping dry food separate from liquid food. The container lid 14 screws securely onto the divided compartment cup and provides a seal against leakage to the outside of the portable food container. The compression seal 15 is provided so that when the container lid 14 is screwed onto the divided compartment cup 12, leakage between compartments is prevented.

Conveniently, the portable food container 10 is constructed and arranged so that it can fit into a regular cup holder such as those found in automobiles. The shape is desirably much like a bicycle water bottle. The hand motions used in operating the portable food container 10 can be somewhat similar to the motion used to operate a bicycle water bottle, or to drink milk from a glass. Namely, in a sequential motion, the user can rotate or invert the portable food container 10 from the upright position shown in FIG. 1 to the dispensing position shown in FIG. 2, thereby allowing the dry food, such as cereal, to flow directly into a persons's mouth. Pressure can then be applied along the direction shown by the arrow in FIG. 2 to squirt a desired amount of liquid in the person's mouth. The amount of pressure needed to squirt the liquid out of the flexible compartment would depend on the amount of liquid desired at a given time. For example, a gentle squeeze would cause a light stream of liquid to be squirted. A more vigorous squeeze would cause a larger volume of liquid to be squirted per unit time.

Protruding lid opening 13 is constructed and arranged to fit within a person's mouth when dispensing. Accordingly, it is designed to extend from the surface of the container lid 14 a distance sufficient to allow a person's mouth to provide a seal therearound. Thus, using this device, one can easily consume a meal of cereal and milk while driving a car or performing another activity which requires the use of one hand without causing a mess. In addition, since the use of the portable food container 10 requires only one hand during operation, it is safer to use while operating dangerous equipment compared with other prior art containers which require the use of two hands.

As shown in FIG. 3, divided compartment cup 12 contains dry food compartment 16 for storing dry food and liquid food compartment 18 for storing liquid food. Divider wall 17 is provided for separating the dry food compartment 16 from the liquid food compartment 18. Dry food compartment 16 is surrounded by rigid wall 20 which protects dry food in the dry food compartment 16 from being crushed by outside forces such as that encountered when the divided compartment cup 12 is squeezed by a human hand. Liquid food compartment 18 is surrounded by flexible wall 22 which is easily deformed upon application of hand pressure thereon.

Container lid 14 is intended to cover dry food compartment 16 and liquid food compartment 18 of divided compartment cup 12. Container lid 14 has threads 23 which engage threads 24 on divided compartment cup 12 to provide a seal around walls 20 and 22 to prevent leakage of dry and/or liquid food therefrom. The bottom surface 26 of the container lid 14 engages the compression seal 15 on the upper surface of the divider wall 17 to prevent leakage between compartments. Thus, it is important to sufficiently tighten the container lid 14 onto the divided compartment cup 12 so that the above seals are sufficiently tight.

The container lid 14 is provided with a dry food opening 27 through which dry food flows, and a liquid food opening 28 through which liquid food flows. The dry food opening 27 is sufficiently large to allow dry food to flow therethrough via gravity. The liquid food opening 28 is preferably sufficiently small to prevent liquid food from flowing therethrough via gravity. Rather, it is intended that the vast majority of the liquid will only flow therethrough upon application of pressure to flexible wall 22.

Snap cap 30 is provided for covering the openings in container lid 14 to provide a seal against leakage. Plastic strap 32 keeps snap cap 30 attached to container lid 14. Snap cap 30 is intended to provide a sufficient seal to keep the cereal dry and fresh during storage. As shown in FIG. 1, the portable food container 10 is in the open position which means that the dry food compartment 16 and the liquid food compartment 18 are exposed to the atmosphere. Dry food and liquid food contained therein can then be dispensed. When the snap cap 30 is snapped over the dry food opening 27 and the liquid food opening 28, the portable food container 10 is referred to as being in the closed position.

Divided compartment cup 12 can be formed by extrusion. The rigid wall 20 and the flexible wall 22 can both be made of any suitable engineering plastic, such as polyethylene. The difference in rigidity between the rigid wall 20 and the flexible wall 22 can be the result of co-extrusion of different polymer materials, or a difference in thickness of the respective walls. Furthermore, the interior of the flexible wall 22 and/or the liquid food compartment side of the divider wall 26 can include additional insulating material, such as foam or gel, which provides desired insulation. As would be apparent to one skilled in the art, the divided compartment cup 12 can be made of any material capable of providing a divided cup having the desired degree of softness, flexibility, and rigidity.

Figure 4:
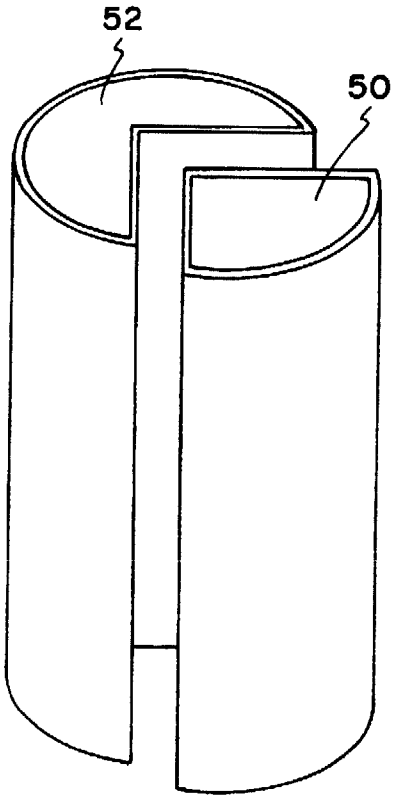
FIG. 4 is an alternative embodiment of the divided compartment cup of the portable food container according to the principles of the present invention wherein the divided cup can separate into two parts.

If desired, the divided compartment cup can be made by forming the individual cups, then combining the cups to form a divided compartment cup as shown in FIG. 4. In this embodiment, the liquid food container 50 can be kept separate from the dry food container 52. Separate covers can be provided for each container for storage to keep the food therein fresh and/or to prevent food contamination. For example, it is possible to store milk or water in the liquid food container 50 in a refrigerator, and store cereal in the dry food container 52 in a pantry or on a shelf. Select containers can then be combined, and a lid placed thereover which keeps the containers together and allows dry and liquid food to be dispensed therefrom. Although not shown in FIG. 4, threads can be provided to a container lid to fit securely thereon.

Figure 5:
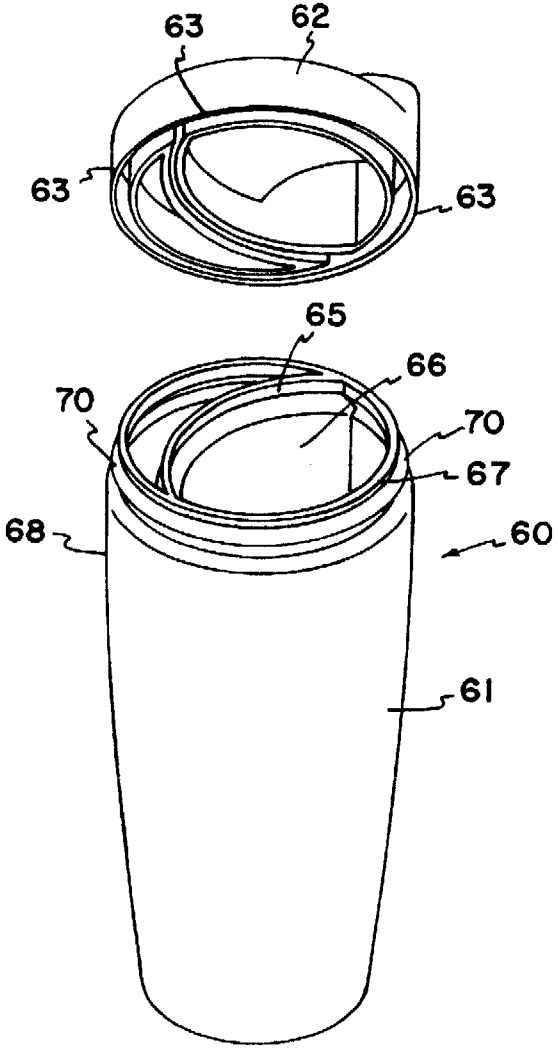
FIG. 5 is a perspective assembly view of an alternative embodiment of the portable food container according to the principles of the present invention where the cup and lid snap together.

Now referring to FIG. 5, an alternative embodiment of the present invention is provided where portable food container 60 is provided with a divided compartment cup 61 and a snap-on container lid 62. The container lid 62 has flanges 63 which fit over rim 65 of the compartment divider 66 and over the rim 67 of the cup wall 68. The rims include a bulging section 70 which helps provide a seal and which helps keep the snap-on container lid 62 attached to the divided compartment cup 61.

Figure 6:
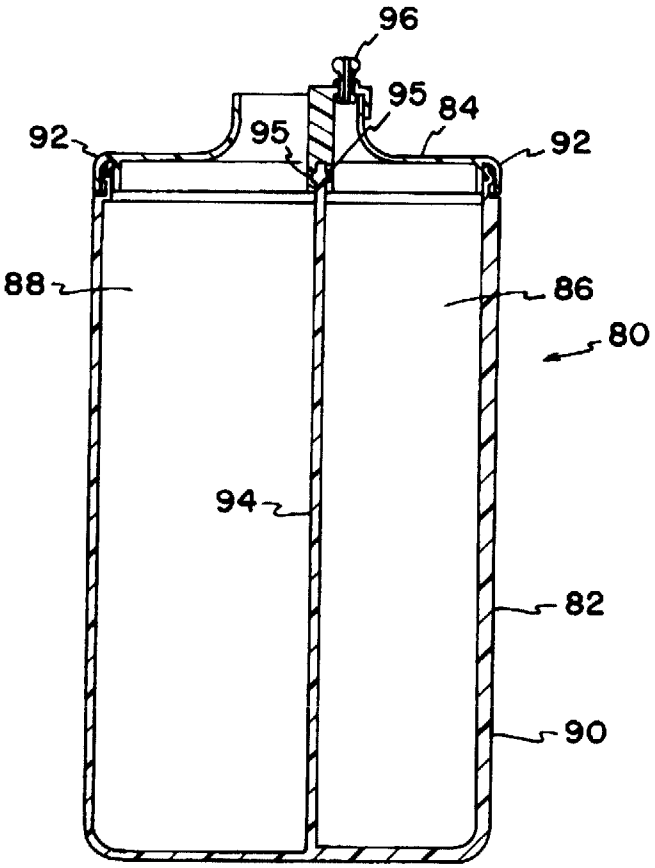
FIG. 6 is a side, cross-sectional view of an alternative embodiment of the portable food container according to the principles of the present invention.

Now referring to FIG. 6, an alternative embodiment of the present invention is provided where portable food container 80 includes divided compartment cup 82 and container lid 84. The divided compartment cup 82 has dry food compartment 88 and liquid food compartment 86. As shown in FIG. 6, the wall 90 of the liquid food compartment has increased thickness to provide desired insulation. The cup 82 is provided with a ridge 92 over which container lid 84 snaps to provide a seal. Compartment divider 94 is provided and contains a ridge 95 over which the container lid 84 snaps to provide a seal to prevent the components of the two compartments from mixing.

Container lid 84 includes a drip free spout 96 which can be operated by pulling out to open, and pushing in to close similar to that used on conventional bicycle water bottles. Thus, liquid food in the liquid food compartment 86 can be squeezed therefrom through drip free spout 96. A cap can be provided for sealing the dry food opening 98 from the environment.

As described above, the preferred divided compartment cup has two enclosed and separate compartments. Basically, these compartments can be partial halves or semi-circle cylinders that run from the bottom to the top of the base unit. One compartment is intended to store dry food, preferably cereal, and the other compartment is intended to store liquid food, preferably milk. Of course, the shape of each compartment can vary according to the teaching of the invention to accommodate the desired configuration for purposes of providing insulation, relative compartment proportions, etc.

The user can hold the portable food container by grasping with one hand, similar to holding a glass of milk. If desired, the surface of the container can be ribbed or indented to form-fit a person's hand to provide better control. The portable food container can be designed right-handed, left-handed, or compatible for both for convenient operation by the desired hand of the user. It is generally desirable, however, for the gripping hand to be capable of squeezing the liquid containing compartment to force liquid therefrom.

As discussed above, the milk and cereal compartments may be constructed as individual pieces. These pieces would be designed to be interlocking which slide together and "snap" in place; the top lid and snap cap would then be attached before use. The liquid compartment could be filled, i.e. with milk, and stored in the refrigerator overnight with the cereal compartment stored in the cupboard. For convenience, multiple containers can be used. For example, a standard workweek supply of five could be filled over the weekend. The milk compartments can be stored in the refrigerator, and the cereal compartments can be stored in the cupboard. On a weekday morning, the milk and cereal compartments can be matched as desired, snapped together, and the container lid added thereto. In another embodiment, the milk compartment may include a drop-in detachable bladder. Preferably, however, the container is dishwasher safe.

The container lid can attach to the divided compartment cup by any desired attachment mechanism. Screw on and snap on are preferred. The entire container lid is preferably removable to allow access to both compartments for easy filling and cleaning.

When the container lid is attached to the divided compartment cup and is in the "locked" position, the dry food opening will preferably be directly above the dry food compartment, and the liquid food spout will be directly above the liquid food compartment. The dry food opening and the liquid food spout are preferably located off-center of the top lid and next to the near rim of the top lid to allow complete dispensing of contents when inverting the portable food container. If desired, the top surface of the container lid can be sloped.

Preferably, the dry food opening will be large enough to allow a desired cereal product to flow therethrough, and may be an oval approximately 1.5 inches wide. The liquid food spout is preferably a drip-free spout like that found on a plastic syrup bottle, common water bottle, etc. The spout can be pulled out to allow flow and pushed in to seal and stop the flow. The flow of liquid can be initiated and regulated by squeezing the container.

The portable food container can accommodate several sizes and several different configurations which are within the scope of the present invention. For example, the size of the portable food container can be altered to be suitable for different food or meal requirements, or to accommodate adult size and child size portions. The configuration of the cup can be altered by compartment arrangement so as to provide different size and shape compartments. The shape of each compartment can be altered to provide increased insulation and/or to provide a surface which is easier to clean. This may accommodate different portion amounts and provide maximum ease of use with different hand sizes. An adult size can have a volume capacity of about 1.5 cups of dry food and about 1.5 cups of liquid milk. A child size can have a volume capacity of about 1.0 cups of dry cereal and about 1.0 cups of milk. The amount of liquid consumed will usually be greater than normally consumed when the foods are mixed in a bowl due to the mixing in a person's mouth. Since the primary mixing of the cereal and milk is intended to take place in the user's mouth, more milk may be consumed per cereal serving than in a similar sized serving being mixed in a bowl.

The dimensions of an adult size portable food container can be approximately about 6.0 inches tall with a diameter of approximately about 3.0 inches. A child size can be proportionately smaller in relation to the volume requirements as stated above. The top rim of the portable food container can be slightly larger tapering down to a smaller base. The circumference of the base preferably accommodates existing cup holders found in console designs in automobiles and portable cup holders designed to hang from car doors.

In addition to cereal and milk, the portable food container of this invention can be used for providing any combination of solid and liquid food such as cookies and milk, crackers and soup, and snacks such as popcorn, potato chips, pretzels, crackers, nuts, trail mix, etc., and soda, fruit drink, beer, fruit juice, etc. In addition, water and water-based fluids are considered liquid food for purposes of this invention.

While the invention has been described in conjunction with a specific embodiment thereof, it is evident that different alternatives, modifications, variations, and uses will be apparent to those skilled in the art in view of the foregoing description. Accordingly, the invention is not limited to these embodiments or the use of elements having specific configurations or shapes as presented herein.

What is claimed is:

1. A method for dispensing dry and liquid food items stored in a portable food container comprising:

providing a portable food container in an upright position, said portable food container comprising a divided compartment cup having a rigid compartment holding dry food and a flexible compartment holding liquid food, and a container lid covering the compartments of said divided compartment cup, said container lid having a first opening for delivering dry food from said rigid compartment and a second opening for delivering liquid food from said flexible compartment;

rotating said portable food container to a dry food and liquid food dispensing position; and squeezing the flexible compartment to delivery liquid food therefrom.

2. The method according to claim 5, wherein said dry food comprises cereal, and said liquid food comprises milk.

3. A method for storing dry and liquid food items in a portable food container prior to consumption, said method comprising:

providing a divided compartment cup having a rigid compartment for holding dry food and a flexible compartment for holding liquid food;

covering the compartments of said divided compartment cup with a container lid, said container lid having a first opening for delivering dry food from said rigid compartment and a second opening for delivering liquid food from said flexible compartment.

4. The method according to claim 3, further comprising providing a cap for covering the openings in said container lid.

5. The method according to claim 3, wherein said dry food comprises cereal, and said liquid food comprises milk.

* * * * *

UNITED STATES PATENT AND TRADEMARK OFFICE

CERTIFICATE OF CORRECTION

PATENT NO. : 5,753,289

DATED : MAY 19, 1998

INVENTOR(S) : NESS

It is certified that error appears in the above-identified patent and that said Letters Patent is hereby corrected as shown below:

Col. 8, line 8: after "liquid food;" insert —adding dry food to the rigid compartment and liquid food to the flexible compartment; and —

Signed and Sealed this

Ninth Day of May, 2000

*Attest:*

Q. TODD DICKINSON

*Attesting Officer*

*Director of Patents and Trademarks*